US006002372A

United States Patent [19]

Sullivan

[11] Patent Number: 6,002,372

[45] Date of Patent: Dec. 14, 1999

[54] COLLAPSIBLE ANTENNA

[75] Inventor: Jonathan L. Sullivan, Lincoln, Nebr.

[73] Assignee: Centurion International, Inc., Lincoln, Nebr.

[21] Appl. No.: 09/150,319

[22] Filed: Sep. 9, 1998

[51] Int. Cl.[6] ..... H01Q 1/24

[52] U.S. Cl. ..... 343/702; 343/895; 343/901

[58] Field of Search ..... 343/702, 725, 343/729, 715, 900, 901, 895, 906; H01Q 1/24, 1/36

[56] References Cited

U.S. PATENT DOCUMENTS

| | | | |
|---|---|---|---|
| 3,803,627 | 4/1974 | Schuscheng | 343/903 |
| 4,205,319 | 5/1980 | Gasparaitis et al. | 343/792 |
| 4,760,401 | 7/1988 | Imazeki | 343/702 |
| 4,772,895 | 9/1988 | Garay et al. | 343/895 |
| 4,849,767 | 7/1989 | Naitou | 343/745 |
| 4,867,698 | 9/1989 | Griffiths | 439/317 |
| 4,868,576 | 9/1989 | Johnson | 343/702 |
| 5,079,558 | 1/1992 | Koike | 343/702 |
| 5,177,492 | 1/1993 | Tomura et al. | 343/702 |
| 5,204,687 | 4/1993 | Elliott et al. | 343/702 |
| 5,218,370 | 6/1993 | Blaese | 343/702 |
| 5,245,350 | 9/1993 | Sroka | 343/702 |
| 5,300,940 | 4/1994 | Simmons | 343/749 |
| 5,317,325 | 5/1994 | Bottomley | 343/702 |
| 5,353,036 | 10/1994 | Baldry | 343/702 |
| 5,374,937 | 12/1994 | Tsunekawa et al. | 343/702 |
| 5,446,469 | 8/1995 | Makino | 343/702 |
| 5,467,096 | 11/1995 | Takamoro et al. | 343/702 |
| 5,469,177 | 11/1995 | Rush et al. | 343/702 |
| 5,479,178 | 12/1995 | Ha | 343/702 |
| 5,594,457 | 1/1997 | Wingo | 343/702 |
| 5,646,635 | 7/1997 | Cockson et al. | 343/702 |
| 5,659,889 | 8/1997 | Cockson | 455/575 |
| 5,717,408 | 2/1998 | Sullivan et al. | 343/702 |
| 5,859,617 | 1/1999 | Fujikawa et al. | 343/702 |
| 5,945,953 | 8/1999 | Tsuda et al. | 343/702 |

FOREIGN PATENT DOCUMENTS

| | | |
|---|---|---|
| 747990A1 | of 0000 | European Pat. Off. . |
| 6252621 | of 0000 | Japan . |
| 685519 | of 0000 | Japan . |

OTHER PUBLICATIONS

"Lightweight Trap Antennas–Some Thoughts" by Doug DeMaw, Jun. 1983.

*Primary Examiner*—Don Wong
*Assistant Examiner*—Tho Phan
*Attorney, Agent, or Firm*—Zarley, McKee, Thomte Voorhees & Sease; Dennis L. Thomte

[57] ABSTRACT

A retractable antenna for a wireless communication device such as a cellular telephone including a housing having a receptacle at the upper end thereof which is RF coupled to the telephone circuitry. The antenna comprises a metal connector which is RF coupled to the housing receptacle. Telescoping first and second radiators are slidably mounted in the metal connector and may be moved from a fully extended position to a fully retracted position. A helical antenna is operatively supported by the metal connector and is RF insulated therefrom. When the antenna is in its fully retracted position, the helical antenna is in circuit, with the telescoping radiators being out of circuit. When the antenna is in its fully extended position, the telescoping radiators are in circuit and the helical antenna is out of circuit. The overall length of the antenna, when in its fully extended position, is greater than the height of the telephone housing.

8 Claims, 2 Drawing Sheets

COLLAPSIBLE ANTENNA

BACKGROUND OF THE INVENTION

1. Field of the Invention

The present invention relates to a method of reducing the length of an antenna when it is in the retracted or stored position and then being able to lengthen the antenna when in the extended user position.

2. Description of the Related Art

Cellular telephones and other electronic and communications devices continue to be designed into smaller packages. Electronic technologies are being pushed to reduce the size of every component associated with these devices to enable the overall size of the package to become smaller, lighter weight and more user-friendly, without allowing a degradation of electrical or mechanical performance. With few exceptions, wireless devices require an external antenna to function properly. Generally speaking, the longer the antenna is, the better it will perform for several reasons. One reason is that less energy will be absorbed by the user's body if the active antenna radiating element is further from the user. Another reason is that the antenna will electrically decouple from the transceiver if it is further away from the device. Yet another reason is that in some cases if the antenna is made at the ½ wave length instead of the traditional ¼ wave length, it will be less affected by the metallic chassis, printed circuit board or other metallic components in the transceiver. Traditional antennas reduce the electrical length of the antennas to allow them to fit into the housing when retracted. Another traditional approach is to allow the coil to protrude from the top of the housing when the antenna is retracted.

SUMMARY OF THE INVENTION

This invention relates to a method of constructing an antenna that will telescope within itself so that when the antenna is stored it will physically fit within the confines of the housing and when extended, the antenna active radiating element will be at its required operating length.

A retractable antenna for a wireless communication device such as a wireless modem, two-way radio or cellular telephone including a housing having a receptacle at the upper end thereof which is RF coupled to the circuitry of the communication device. The antenna of this invention comprises a metal connector positioned in the receptacle and being RF coupled thereto. An elongated first radiator is provided having a metal bottom stop mounted on the lower end thereof which is RF coupled thereto. A first metal contact is provided at the upper end of the first radiator which is RF coupled thereto. An insulating sheath covers the first radiator between the upper end of the metal bottom stop and the lower end of the first metal contact. A second radiator is also provided which is comprised of an elongated metal tube which slidably receives the first metal contact and the first radiator. The first metal contact on the first radiator is RF coupled to the metal tube. An elongated, non-electrically conductive member is secured to the upper end of the metal tube and has a second metal contact positioned thereon. A helical antenna is positioned above the metal connector and is operatively supported thereby. An insulating cap encloses the helical antenna in conventional fashion. A third metal contact is positioned on the metal connector and is RF connected thereto. The first and second radiators are movable from a fully retracted position to a fully extended position. The lower end of the helical antenna is RF coupled to the metal connector, through the second metal contact, when the first and second radiators are in their fully retracted position. The helical antenna is RF decoupled from the metal connector when the first and second radiators are in their fully extended position. The first and second radiators are RF coupled to the metal connector when in their fully extended position. The first and second radiators have a combined length, when in their fully extended position, which is greater than the height of the housing of the communication device.

It is therefore a principal object of the invention to provide a retractable collapsible antenna.

Further, it is a principal object of the invention to provide a retractable antenna for a cellular telephone which is cost-effective to manufacture and which is easy to manufacture.

Yet another object of the invention is to provide a retractable antenna which may be retrofitted to existing designs.

Yet another object of the invention is to provide a retractable antenna for a small cellular telephone which permits longer radiators to be utilized.

Still another object of the invention is to provide a retractable antenna for a cellular telephone wherein the antenna, when extended, has a length greater than the height of the telephone housing.

These and other objects will be apparent to those skilled in the art.

DESCRIPTION OF THE PREFERRED EMBODIMENT

Figure 1:
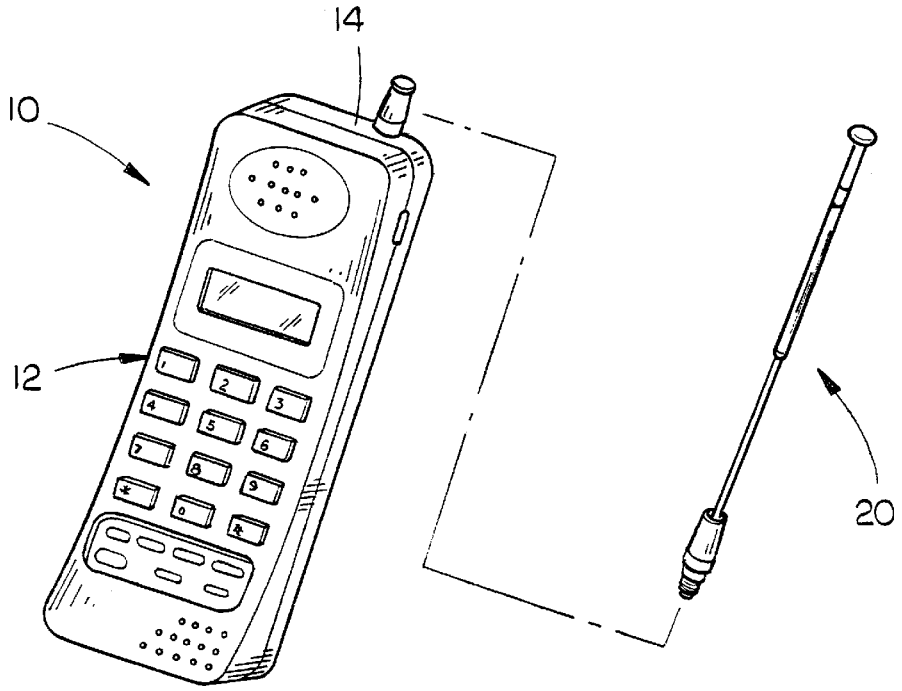
FIG. 1 is a perspective view of the antenna of this invention illustrating it being mounted on a telephone and being removed therefrom.
Figure 2:
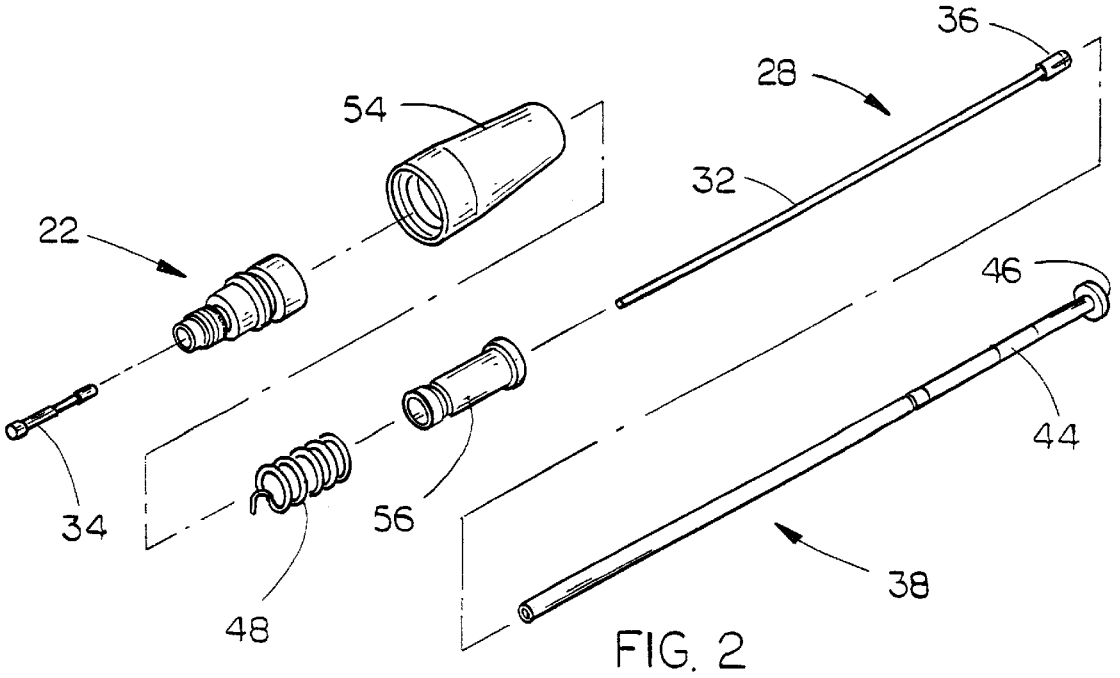
FIG. 2 is an exploded perspective view of the antenna of this invention.

The numeral 10 refers to a conventional cellular telephone including a housing 12 which contains conventional circuitry therein. The upper end 14 is provided with a conventional metal receptacle which is RF coupled to the circuitry within the housing 12. Receptacle 16 includes a bore extending therethrough. Although a cellular telephone is illustrated and described, the antenna of this invention may be used with other wireless communication devices such as a modem, two-way radio, etc.

The retractable antenna of this invention is referred to by the reference numeral 20. Antenna 20 includes a metal connector 22 which is adapted to be threadably secured to the bore of the metal receptacle in the telephone 10 in conventional fashion. For purposes of description, connector 22 will be described as having a bore 24 extending therethrough which terminates in a compartment or cavity 26 at the upper end thereof, as will be described in more detail hereinafter. In some cases, the current (RF) passes from a contact mounted on the circuit board of the telephone circuitry directly to the antenna radiator bypassing the connector 22.

The numeral 28 refers to a first cable antenna element or radiator which includes elongated wire 30 which is covered with an insulating sheath 32. A metal bottom stop 34 is mounted on the lower end of the wire 30 and is RF coupled thereto. A metal contact 36 is mounted on the upper end of the wire 30 and is also RF coupled thereto. As seen in the drawings, the insulating material 32 extends between the bottom stop 34 and the metal contact 36.

The numeral 38 refers to an elongated, metal tube which acts as a second radiator in the antenna of this invention. As seen in the drawings, the metal contact 36 and the radiator 20 are slidably received in the lower end of the metal tube 38 so that the metal contact 36 is RF coupled to the metal tube 38. As also seen in the drawings, the lower end of metal tube 38 is crimped at 40 to prevent the separation of the radiator 28 from the metal tube 38. An elongated, non-electrically conductive member 42 is secured to the upper end of tube 38 and extends upwardly therefrom. A metal sliding contact 44 is provided on the member 42 between the ends thereof, as seen in the drawings. A top stop 46 is mounted on the upper end of the member 42 to limit the downward movement of the radiators, as will be described in more detail hereinafter.

Figure 3:
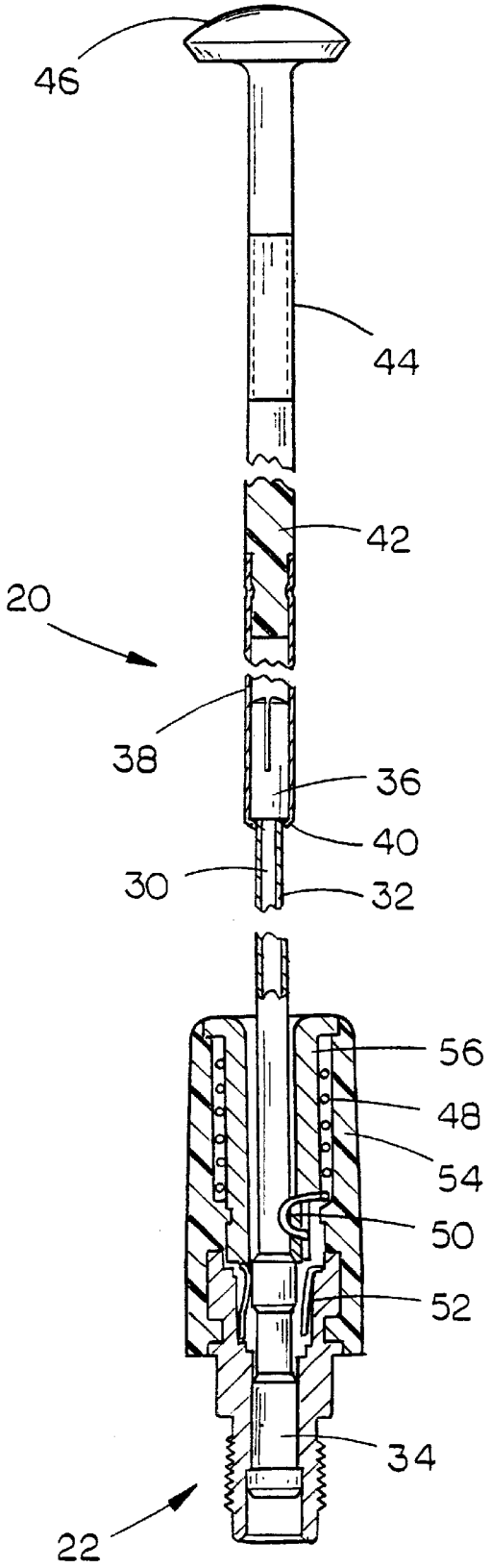
FIG. 3 is a partial longitudinal sectional view of the antenna of this invention in its fully extended position.

The numeral 48 refers generally to a helical antenna which is operatively supported on the connector 22, as illustrated in the drawings, and which is RF insulated therefrom. Spring contact 50 is electrically connected to the lower end of the helical antenna 48, as seen in FIG. 3. Contact 52 is positioned in compartment 26 and is electrically connected to the connector 22 in conventional fashion. The helical antenna 48 is enclosed by a conventional cap 54 which is comprised of a conventional insulated plastic material. Insert 56 is positioned inwardly of the helical antenna 48 and has a bore 58 extending therethrough which receives the radiators, as seen in the drawings.

When the antenna is in its fully extended position, as illustrated in FIG. 3, the metal bottom stop 34 is RF coupled to the connector 22 so that the radiators 28 and 38 are in circuit. The overall length of the radiators 28 and 38, when in their extended position, is greater than the height of the housing 12. When the antenna is in its extended mode, spring 50 is in engagement with the plastic covering 32 so that the helical antenna 48 is decoupled from the telephone circuit.

Figure 4:
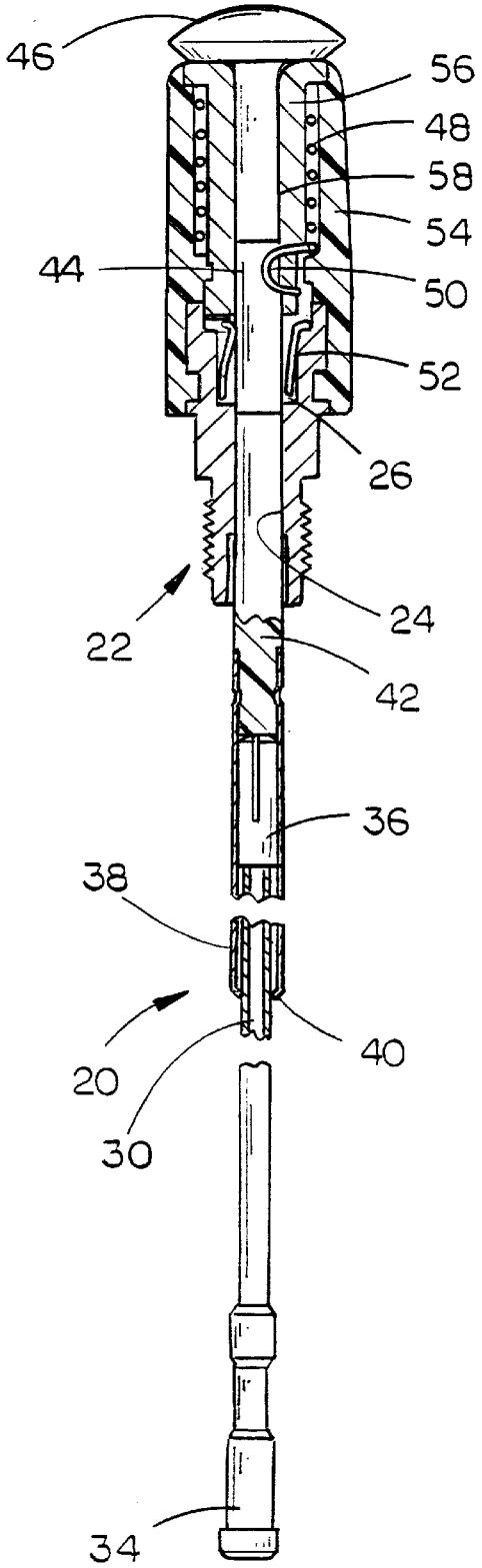
FIG. 4 is a view similar to FIG. 3 except that the antenna is illustrated in its fully retracted position.

When it is desired to move the antenna from its fully extended position to its fully retracted position, the top stop 46 is pushed downwardly with respect to the telephone which causes the bottom stop 34 to slidably move downwardly with respect to connector 22 until the bottom stop 34 engages the bottom of the telephone housing at which time continued movement of the radiator 38 with respect to the radiator 28 will cause radiator 28 to be slidably received within the interior of radiator 38 until such time as the top stop 46 engages the upper end of the insert 56, as illustrated in FIG. 4. When the antenna is in its fully retracted position, spring 50 is in electrical contact with the upper portion of the contact 44. The lower portion of the contact 44 is in electrical contact with the contact 52 so that the helical antenna 48 will be RF coupled to the telephone circuitry.

Thus it can be seen that a novel retractable antenna has been described which has an overall length, when in its fully extended position, which is greater than the height of the telephone housing. The combined length of the radiators 28 and 38 enables the antenna to be positioned farther from the user's head which increases performance of the antenna. The antenna of this invention is durable in use and is economical of manufacture. Further, the antenna of this invention may be retrofitted to existing designs.

Thus it can be seen that the antenna of this invention accomplishes at least all of its stated objectives.

I claim:

1. A retractable antenna for a wireless communication device including a housing having a receptacle at the upper end thereof which is RF coupled to the device circuitry, said receptacle having a bore extending therethrough, comprising:

a metal connector, having upper and lower ends, positioned in the bore of the receptacle and being RF coupled thereto;

an elongated, first radiator having upper and lower ends;

a metal bottom stop mounted on the lower end of said first radiator and being RF coupled thereto;

a first metal contact at the upper end of said first radiator and being RF coupled thereto;

an insulating sheath means covering said first radiator between said metal bottom stop and said first metal contact;

a second radiator comprising an elongated metal tube having upper and lower ends;

said first metal contact and said first radiator being slidably received by said metal tube;

said first metal contact being RF coupled to said metal tube;

an elongated, non-electrically conductive member, having upper and lower ends;

said lower end of said non-electrically conductive member being secured to said upper end of said metal tube and extending upwardly therefrom;

a second metal contact positioned on said non-electrically conductive member;

a helical antenna, having upper and lower ends, positioned above said metal connector and being operatively supported thereby;

an insulating cap means enclosing said helical antenna;

a third metal contact positioned on said metal connector and being RF coupled thereto;

said first and second radiators being movable from a fully retracted position to a fully extended position;

said lower end of said helical antenna being RF coupled to said metal connector, through said second metal contact and said third metal contact, when said first and second radiators are in their said fully retracted position;

said helical antenna being RF decoupled from said metal connector when said first and second radiators are in their said fully extended position;

said first and second radiators being RF coupled to said metal connector when in their said fully extended position.

2. The antenna of claim 1 wherein said first and second radiators have a combined length, when in their said fully extended position, which is greater than the height of the telephone housing.

3. The antenna of claim 1 wherein said first and second radiators are RF decoupled from said metal connector when in their said fully retracted position.

4. The antenna of claim 1 wherein said helical antenna comprises a ¼ wave antenna and wherein said first and second radiators comprise, in combination, a ¼ wave antenna.

5. A retractable antenna for a wireless communication device including a housing having a receptacle at the upper end thereof; said receptacle having a bore extending therethrough, said communication device including circuitry, comprising:

a connector, having upper and lower ends, positioned in the bore of the receptacle;

an elongated, first radiator having upper and lower ends;

a metal bottom stop mounted on the lower end of said first radiator and being RF coupled thereto;

a first metal contact at the upper end of said first radiator and being RF coupled thereto;

an insulating sheath means covering said first radiator above said metal bottom stop and below said first metal contact;

a second radiator comprising an elongated metal tube having upper and lower ends;

said first metal contact and said first radiator being slidably received by said metal tube;

said first metal contact being RF coupled to said metal tube;

an elongated, non-electrically conductive member, having upper and lower ends;

said lower end of said non-electrically conductive member being secured to said upper end of said metal tube and extending upwardly therefrom;

a second metal contact positioned on said non-electrically conductive member;

a helical antenna, having upper and lower ends, positioned above said connector and being operatively supported thereby;

an insulating cap means enclosing said helical antenna;

a third metal contact positioned on said connector and being RF coupled thereto;

said first and second radiators being movable from a fully retracted position to a fully extended position;

said lower end of said helical antenna being RF coupled to the circuitry of the device, through said second metal contact and said third metal contact, when said first and second radiators are in their said fully retracted position;

said helical antenna being RF decoupled from the circuitry of the device when said first and second radiators are in their said fully extended position;

said first and second radiators being RF coupled to the circuitry of the device when in their said fully extended position.

6. The antenna of claim 5 wherein said first and second radiators have a combined length, when in their said fully extended position, which is greater than the height of the housing.

7. The antenna of claim 5 wherein said first and second radiators are RF decoupled from the circuitry of the device when in their said fully retracted position.

8. The antenna of claim 5 wherein said connector is metal and wherein said connector is RF coupled to the circuitry of the device.

* * * * *